US009656377B2

(12) United States Patent
Moore et al.

(10) Patent No.: US 9,656,377 B2
(45) Date of Patent: May 23, 2017

(54) SELF-CHARGING HYDRAULIC HAMMER

(71) Applicant: CATERPILLAR INC., Peoria, IL (US)

(72) Inventors: Cody Thomas Moore, Waco, TX (US); Bart A. Fisher, Roanoke, IL (US)

(73) Assignee: Caterpillar Inc., Peoria, IL (US)

( * ) Notice: Subject to any disclaimer, the term of this patent is extended or adjusted under 35 U.S.C. 154(b) by 336 days.

(21) Appl. No.: 14/455,715

(22) Filed: Aug. 8, 2014

(65) Prior Publication Data

US 2016/0039080 A1 Feb. 11, 2016

(51) Int. Cl.

| | |
|---|---|
| ***F01B 7/00*** | (2006.01) |
| ***B25D 9/18*** | (2006.01) |
| ***F15B 11/072*** | (2006.01) |
| ***B25D 9/12*** | (2006.01) |
| ***B25D 9/16*** | (2006.01) |

(52) U.S. Cl.

CPC ..... *B25D 9/18* (2013.01); *B25D 9/12* (2013.01); *B25D 9/16* (2013.01); *F15B 11/072* (2013.01); *B25D 2250/375* (2013.01)

(58) Field of Classification Search

CPC ... F15B 11/032; F15B 11/072; F15B 11/0725; B25D 9/12

See application file for complete search history.

(56) References Cited

U.S. PATENT DOCUMENTS

| | | | |
|---|---|---|---|
| 3,974,885 | A | 8/1976 | Sudnishnikov et al. |
| 4,932,479 | A | 6/1990 | Pyatov |
| 5,064,005 | A | 11/1991 | Krone |
| 6,119,796 | A | 9/2000 | Schmid |
| 7,793,811 | B1 | 9/2010 | Pedicini et al. |

FOREIGN PATENT DOCUMENTS

| | | |
|---|---|---|
| DE | 102011088490 | 6/2013 |
| GB | 125954 | 7/1920 |
| GB | 823766 | 11/1959 |
| KR | 1020130138074 | 12/2013 |

*Primary Examiner* — Michael Leslie

(74) *Attorney, Agent, or Firm* — Procopio, Cory, Hargreaves & Savitch LLP

(57) ABSTRACT

A self-charging assembly having a first side wall, a second side wall, a third sidewall, a first chamber, a second chamber, a first valve assembly, and a second valve assembly. The second side wall is disposed within the first side wall. The third sidewall connects the first side wall and the second side wall. The first chamber is defined by the first, second, and third sidewalls. The second chamber is disposed within the first chamber and is defined by the second side wall. The first valve assembly is configured to selectively place an interior portion of the second chamber in communication with an atmosphere outside of the self-charging assembly. The second valve assembly is configured to selectively place an interior portion of the first chamber in communication with the interior portion of the second chamber.

16 Claims, 13 Drawing Sheets

SELF-CHARGING HYDRAULIC HAMMER

TECHNICAL FIELD

This patent disclosure relates generally to hydraulic hammers and, more particularly to a self-charging hydraulic hammer.

BACKGROUND

Hydraulic hammers are used on work sites to break up large hard objects before such objects can be moved away. Hydraulic hammers may be mounted to back hoes or excavators or other machines. Typically, the hammer assembly is powered by either a hydraulic or pneumatic pressure source or a combination of both. With those hammer assemblies powered by a combination of hydraulic and pneumatic pressure, a piston is retracted against a volume of compressible gas by applying a hydraulic fluid pressure to a first shoulder of a piston. As the piston retracts, the volume of gas decreases, increasing its pressure. Once the piston reaches a predetermined position, high pressure hydraulic fluid is applied to a second shoulder of a piston that drives the piston in a downward direction for a work or power stroke. The downward movement of the piston allows the compressed gas to expand, releasing energy which further propels the downward movement of the piston. The work tool strikes the object to be broken up. During the power stroke, the downward moving piston strikes a work tool, which, in turn, is driven in the downward direction. In order to provide the additionally energy released from the expansion of the compressed gas, the hammer assembly is pre-charged with the volume of compressed gas before operation.

German Patent Application to 102011088490A1 is directed to a device having a striker provided in a hammer pipe and accelerated by a pneumatic spring unit in an axial direction. The pneumatic spring unit includes three air chambers, which are separated from each other. A controllable valve element ventilates the air chambers of the pneumatic spring unit. One of the air chambers is arranged between a piston and a bottom of the hammer pipe in the axial direction. The other two air chambers partially form a pneumatic spring. However, no mechanism for self-charging the pneumatic spring is disclosed.

SUMMARY OF THE DISCLOSURE

In one embodiment of the present application, a self-charging assembly for a hammer assembly is provided. The self-charging assembly includes a first side wall, a second side wall, a third sidewall, a first gas chamber, a second gas chamber, a first valve assembly, and a second valve assembly. The second sidewall is disposed within the first sidewall. The third sidewall connects the first sidewall and the second sidewall. The first gas chamber is defined by the first sidewall, the second sidewall, and the third sidewall. The first gas chamber is configured to hold a compressible gas. The second gas chamber is disposed within the first gas chamber and is defined by the second sidewall. The second gas chamber is also configured to hold a compressible gas. The first valve assembly is configured to selectively place an interior portion of the second gas chamber in communication with an atmosphere outside of the self-charging assembly. The second valve assembly is configured to selectively place an interior portion of the first gas chamber in communication with the interior portion of the second gas chamber.

Another embodiment of the present application provides a self-charging assembly for a hydro-mechanical device. The self-charging assembly includes a first gas chamber, a second gas chamber, a first flow passage, and a second flow passage. The first gas chamber is configured to hold a compressible gas. The second gas chamber is disposed within the first gas chamber. The second gas chamber is configured to hold a compressible gas. The first flow passage connects an interior portion of the second gas chamber with an atmosphere outside of the self-charging assembly. The first flow passage has a first valve assembly configured for selectively blocking flow through the first flow passage. The second flow passage connects an interior portion of the first cylindrical gas chamber with the interior portion of the second cylindrical gas chamber. The second flow passage has a second valve assembly configured for selectively blocking flow through the second flow passage.

Another embodiment of the present application provides a method of charging a hydro-mechanical device having a self-charging assembly with a compressible gas. The self-charging assembly defines a first gas chamber and a second gas chamber. The self-charging assembly also has a piston movably disposed in the self-charging assembly adjacent the second gas chamber. The method includes moving the piston toward the second gas chamber to decrease an internal volume of the second gas chamber. The method also includes opening an inflow valve to allow communication from the second gas chamber to the first gas chamber, when a pressure within the second gas chamber exceeds the within the first gas chamber. Further the method includes closing the inflow valve to block communication from second gas chamber to the first gas chamber when the pressure within the first gas chamber equals of is less than the pressure within the second gas chamber. The method also includes moving the piston away from the second gas chamber to increase an internal volume of the second gas chamber. Still further the method includes opening a first valve assembly to allow communication between the second gas chamber and an atmosphere outside the self-charging assembly. The method also includes moving the piston toward the second gas chamber to decrease an internal volume of the second gas chamber. Further the method includes closing the first valve assembly to block communication between the second gas chamber and the atmosphere outside the self-charging assembly. Finally, the method includes opening an outflow valve to allow communication from the first gas chamber to the second gas chamber.

DETAILED DESCRIPTION

Figure 2:
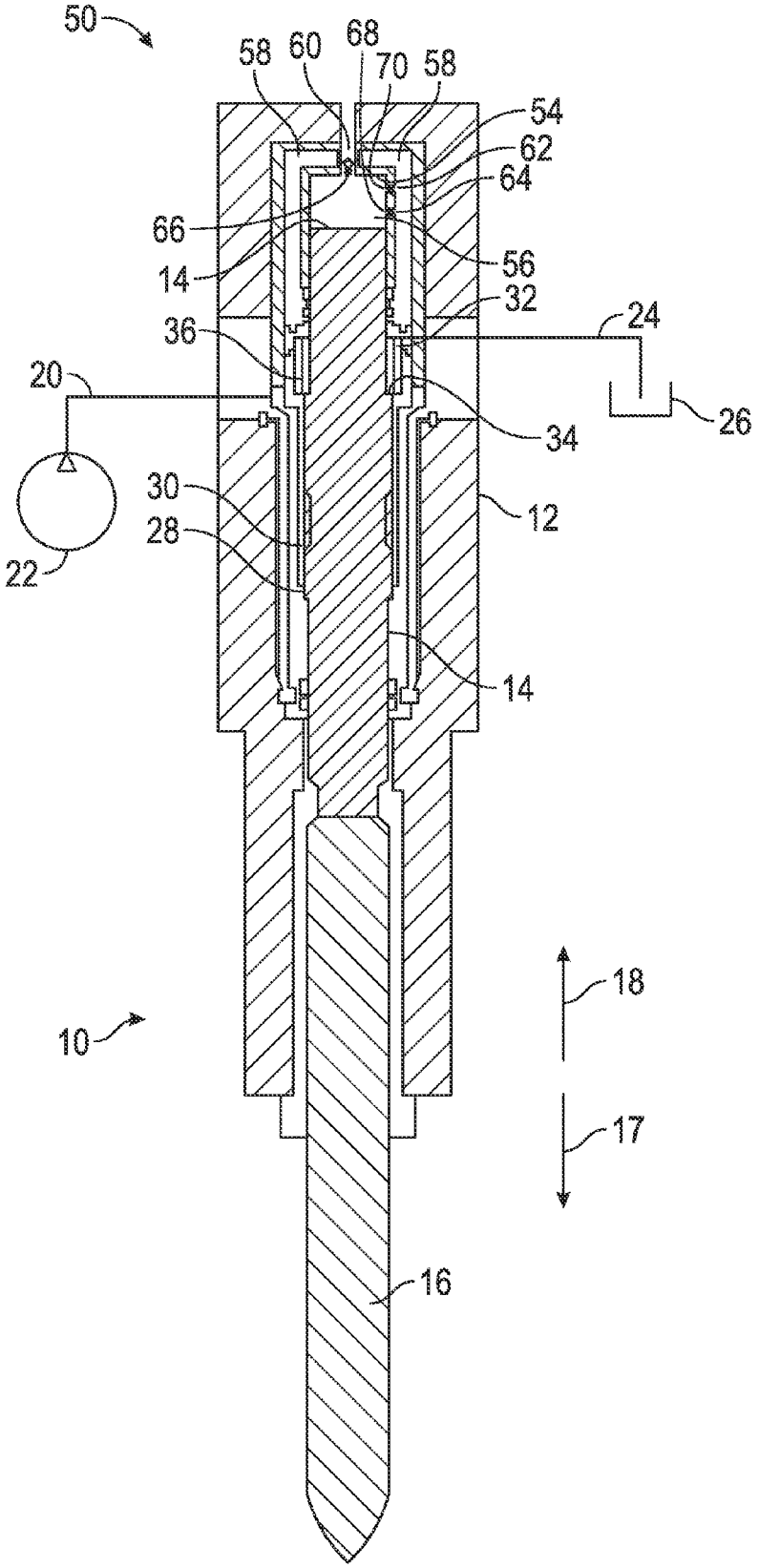
FIG. 2 is a schematic side sectional view of a hammer assembly according to an embodiment of the present disclosure.

This disclosure relates to a self-charging assembly having two gas chambers and a series of valve assemblies that can be used to charge the gas chambers with compressed gas without reliance on an external compressed gas source. With particular reference to FIG. 2 of the drawings, a cross-sectional view of an exemplary hammer assembly 10 is provided. As may be understood by a person of ordinary skill in the art, the hammer assembly 10 may be attached to any suitable machine such as an excavator, backhoe loader, skid steer or similar machine. While the self-charging assembly is illustrated and described in connection with a hammer assembly, the self-charging assembly has applicability in various other types of machines as well. For example, the accumulator assembly may be used in any application involving a fluid system that is subject to pressure.

Figure 1:
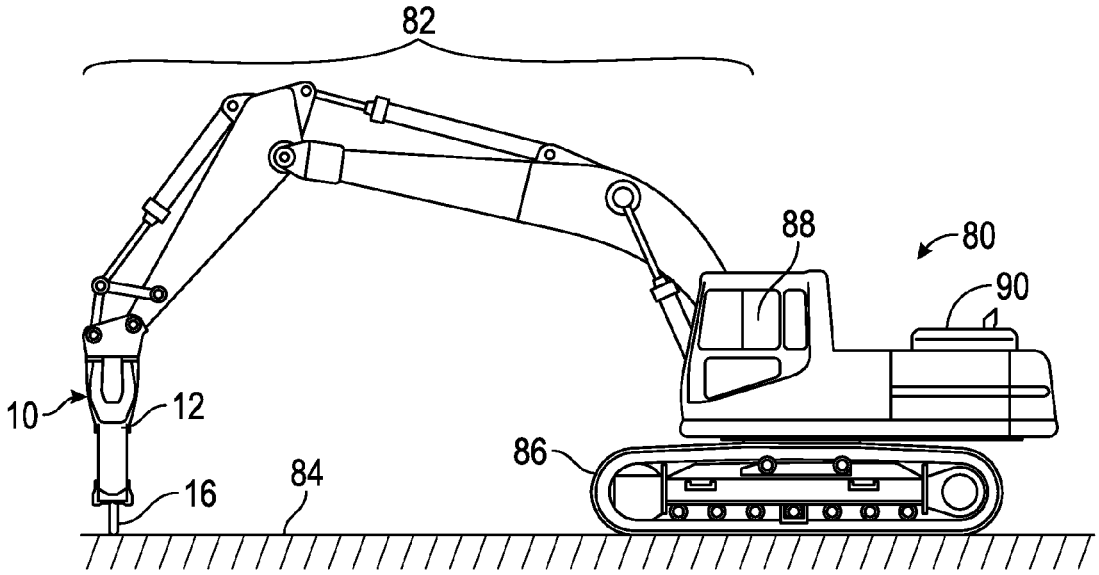
FIG. 1 is a perspective view of an example machine, which may us a hammer assembly according to an embodiment of the present disclosure.

FIG. 1 is a perspective view of an example machine, which may us a hammer assembly according to an embodiment of the present disclosure. Referring to FIG. 1, a demolition hammer 10 is attached to a machine 80. The machine 80 may embody a fixed or mobile machine that performs some type of operation associated with an industry such as mining, construction, farming, transportation, or any other industry known in the art. For example, machine 80 may be an earth moving machine such as a backhoe, an excavator, a dozer, a loader, a motor grader, or any other earth moving machine. Machine 80 may include an implement system 82 configured to move the demolition hammer 10, a drive system 86 for propelling the machine 80, a power source 90 that provides power to implement system 82 and drive system 86, and an operator station 88 for operator control of implement system 82 and drive system 86.

Power source 90 may embody an engine such as, for example, a diesel engine, a gasoline engine, a gaseous fuel-powered engine or any other type of combustion engine known in the art. It is contemplated that power source 90 may alternatively embody a non-combustion source of power such as a fuel cell, a power storage device, or another source known in the art. Power source 90 may produce a mechanical or electrical power output that may then be converted to hydraulic pneumatic power for moving the implement system 14.

Implement system 82 may include a linkage structure acted on by fluid actuators to move the hammer 10. The linkage structure of implement system 82 may be complex, for example, including three or more degrees of freedom. The implement system 82 may carry the hammer 10 for breaking an object or ground surface 84. The structure and operation of a hammer 10 are described in greater detail below.

FIG. 2 is a schematic side sectional view of a hammer assembly 10 according to an embodiment of the present disclosure. In some embodiments, the hammer assembly 10 may be symmetrical forming an enclosed assembly with one or more openings providing access to an interior of the assembly. As shown in FIG. 2, the hammer assembly 10 may include a cylindrical housing 12 within which a piston 14 may be slidably supported. Additionally, a work tool 16 may be supported in a lower end of the housing 12 with a portion of the work tool 16 extending outward therefrom. The work tool 16 may have any configuration, such as for example a chisel, that would be useful in hammering applications. The work tool 16 also may be configured so as to be removable so as to allow a variety of tools with different configurations to be attached to the hammer assembly 10.

The piston 14 may be supported so as to be movable relative to the housing 12 in a reciprocating manner generally in the direction of arrows 17 and 18 in FIG. 2. More specifically, during an impact or work stroke, the piston 14 moves in the general direction of arrow 17 and near the end of the work stroke comes into contact with the work tool 16 such as shown in FIG. 2. Conversely, during a return stroke, the piston 14 retracts away from contact with the work tool 16 (the position shown in FIG. 2) in the general direction of arrow 18. The reciprocating impacts of the piston 14 on the work tool 16, in turn, drive a corresponding reciprocating movement of the work tool 16. When the piston 14 strikes the work tool 16, the force of the piston 14 is transmitted to the work tool 16 in the general direction of arrow 17. This force may be applied to a hard object such as rock, concrete or asphalt in order to break up the object.

The reciprocating movement of the piston 14 may be driven, at least in part, by pressurized fluid, such as pressurized hydraulic fluid, provided by a high pressure source connected to the power source 90 of the machine 80 via the implement system 82 To this end, the hammer assembly 10 may include a high pressure inlet 20 which is coupled to or in communication with a high pressure source, such as a hydraulic pump 22, and an outlet 24 which is coupled to or in communication with a low pressure such as a reservoir or tank 26 (both the inlet 20 and outlet 24 are shown schematically in FIG. 2). The pump 22 and tank 26 may be provided by connecting the hammer assembly 10 to the hydraulic system of the machine 80 via the implement system 82.

For moving the piston 14 in a first or upward direction away from the work tool (i.e., in the direction of arrow 18), the piston 14 may include a first or upward fluid engagement surface 28 that may be exposed to fluid pressure in a first fluid chamber 30 that is defined in the housing 12. The upward fluid engagement surface 28 may be in the form of an annular shoulder provided in the surface of the piston 14 and may be configured or oriented for moving the piston 14 in the direction of arrow 18 away from the work tool 16. For moving the piston 14 in a second or downward direction towards the work tool 16 (i.e., in the direction of arrow 17), the piston 14 may further include a second or downward fluid engagement surface 32 that may be exposed to fluid pressure in a second fluid chamber 34. In this case, the downward fluid engagement surface 32 is arranged above the upward fluid engagement surface 28 on the piston 14 and also is in the form of an annular shoulder in the surface of the piston 14. The downward fluid engagement surface 32 may be configured with a larger effective surface area than the upward fluid engagement surface 28 such that the piston 14 is driven downward in the general direction of arrow 17 when both the first and second fluid chambers 30, 34 are in communication with the high pressure inlet 20. When only the first fluid chamber 30 is in communication with the high pressure inlet 20, high pressure fluid only acts on the upward fluid engagement surface 28 and the piston 14 is driven upward.

A control valve assembly 36 may be provided that selectively connects the second fluid chamber 34 with either the high pressure inlet 20 or the low pressure outlet 24. The control valve assembly 36 may be configured such that movement of the piston 14 switches the control valve assembly 36 between connecting the second fluid chamber 34 with the high pressure inlet 20 and the low pressure outlet 24. In particular, the control valve assembly 36 may be configured such that when the piston 14 reaches a predetermined point in its upward return stroke, the control valve assembly 36 moves, such as in response to the application of a pilot pressure, to connect the second fluid chamber 34 with the pump 22. The engagement of the high pressure fluid in the second fluid chamber 34 with the downward fluid engagement surface 32 stops the upward return stroke of the piston 14 and helps start the downward work stroke of the piston 14. Likewise, the control valve assembly 36 may be configured such that when the piston 14 reaches a predetermined point in its downward work stroke, the second fluid chamber 34 is connected to the tank 26 causing the high pressure fluid to vacate the second fluid chamber 34. This permits the piston 14 to begin its upward return stroke again in response to fluid pressure in the first fluid chamber 30 acting on the upward fluid engagement surface 28.

While a particular pressurized fluid system has been described, those skilled in the art will appreciate that the present disclosure is not limited to any particular pressurized fluid system and that any suitable arrangement capable of driving upward and downward reciprocating movement of the piston may be used.

To generate a further downward force on the piston 14 for the work stroke, a cylindrical gas chamber 56 (henceforth referred to as the second gas chamber 56) may be provided in an upper portion of the housing 12 and into which an upper portion of the piston 14 extends. The second gas chamber 56 may be charged with a trapped pressurized gas that is compressible. According to one or more embodiments of the present application, the second gas chamber 56 may be a component of a self-charging assembly 50, which may perform a self-charging process to charge the hammer assembly 10 with pressurized gas as discussed below. The second gas chamber 56 and piston 14 may be configured and arranged such that when the piston 14 retracts into the second gas chamber 56 during its return stroke the piston 14 reduces the effective volume of the second gas chamber 56 thereby compressing the gas. This increases the pressure of the gas in the second gas chamber 56 and produces a downward biasing force on the upper end surface of the piston 14. The downward biasing force on the piston increases the further the piston 14 is retracted into the second gas chamber 56. When the second fluid chamber 34 is connected to the pump 22 initiating the downward work stroke of the piston 14, the biasing force from the compressed gas in the second gas chamber 56 combines with the downward force from the high pressure fluid acting on the downward fluid engagement surface 32 to drive the piston 14 downward and into engagement with the work tool 16.

In an embodiment of the present application, the self-charging assembly 50 includes a first gas chamber 58, the second gas chamber 56, a first passage 60 connecting the interior portion of the second gas chamber 56 with an atmosphere outside of the hammer housing 12, and a pair of second flow passages (inlet passage 62 and outlet passage 64) connecting the interior portion of the first gas chamber 58 with the interior portion of the second gas chamber 56. Though a pair of second flow passages are illustrated in the embodiment discussed, embodiments of the present application are not limited to a pair of second flow passages and may include a single flow passage or more than 2 second flow passages as may be apparent to a person of ordinary skill in the art.

The first gas chamber 58 may be formed by a first (outer) side wall 52 of the housing 12 and a second (inner) side wall 54 of the housing 12 with a third side wall 55 separating the first side wall 52 and the second side wall 54. The second gas chamber 56 may be located inside of the first gas chamber 58 and may be formed by the second (inner) side wall 54 of the housing 12. The piston 14 is movably disposed within the second gas chamber 56 as discussed above.

In some embodiments, the first gas chamber 58 may be formed as a fully enclosed cylindrical chamber isolated from an exterior atmosphere outside of the hammer assembly 10 by the housing 12. Further, the second gas chamber 56 may be formed as another cylindrical gas chamber, fully disposed within the first gas chamber 58, and connected to the atmosphere outside of the hammer housing 12 by the first passage 60. In such embodiments, the first gas chamber 58 and the second gas chamber 56 may be connected by the pair of second flow passages (i.e. inlet passage 62 and outlet passage 64) and the first gas chamber 58 may only communicate with the an exterior atmosphere outside of the hammer assembly 10 through the pair of second flow passages (i.e. inlet passage 62 and outlet passage 64), second gas chamber 56 and the first flow passage 60. However, embodiments of the present application are not limited to this configuration and may have any other configuration, which may be apparent to a person of ordinary skill in the art.

A first valve assembly 66 may be disposed in the first passage 60 to selectively block/allow flow through the first passage 60. A second valve assembly 72 (labeled in FIGS. 2-10 described below), formed by an outflow valve 68 and an inflow valve 70, may be disposed in the pair of second flow passages to selectively block/allow flow through the pair of second flow passages. For example, an inflow valve 70 may be disposed in the inlet passage 62 to selectively block/allow flow through the inlet passage 62. Further, as another example, an outflow valve 68 may be disposed in the outlet passage 64 to selectively block/allow flow through the outlet passage 64. In some embodiments, the outflow valve 68 and the inflow valve 70, which form the second valve assembly 72 (labeled in FIGS. 2-10 described below), may configured to control flow between the first gas chamber 58 and the second gas chamber 56. In some embodiments, one or more of the first valve assembly 66, the outflow valve 68 and the inflow valve 70 may be a one directional check valve having a biasing member (such as a spring member) configured to hold the check valve closed until a pressure differential across the check valve become sufficient to overcome the bias member and cause the valve to open. However, embodiments are not limited to check valves and may include any type of valve and/or valve assembly, which may be apparent to a person of ordinary skill in the art, including but not limited to manual control valves, automated control valves having integrated or separate sensors, and any other valve as may be apparent. For example, the first valve assembly 66, outflow valve 68, and inflow valve 70 may be an electronically controllable valve controlled by a microprocessor based controller, or any other valve structure, which may be apparent to a person of ordinary skill in the art.

FIGS. 3-11 are enlarged views of the self-charging assembly 50 at different stages of a self-charging process of the hammer assembly 10 according to an embodiment of the present disclosure.

Figure 3:
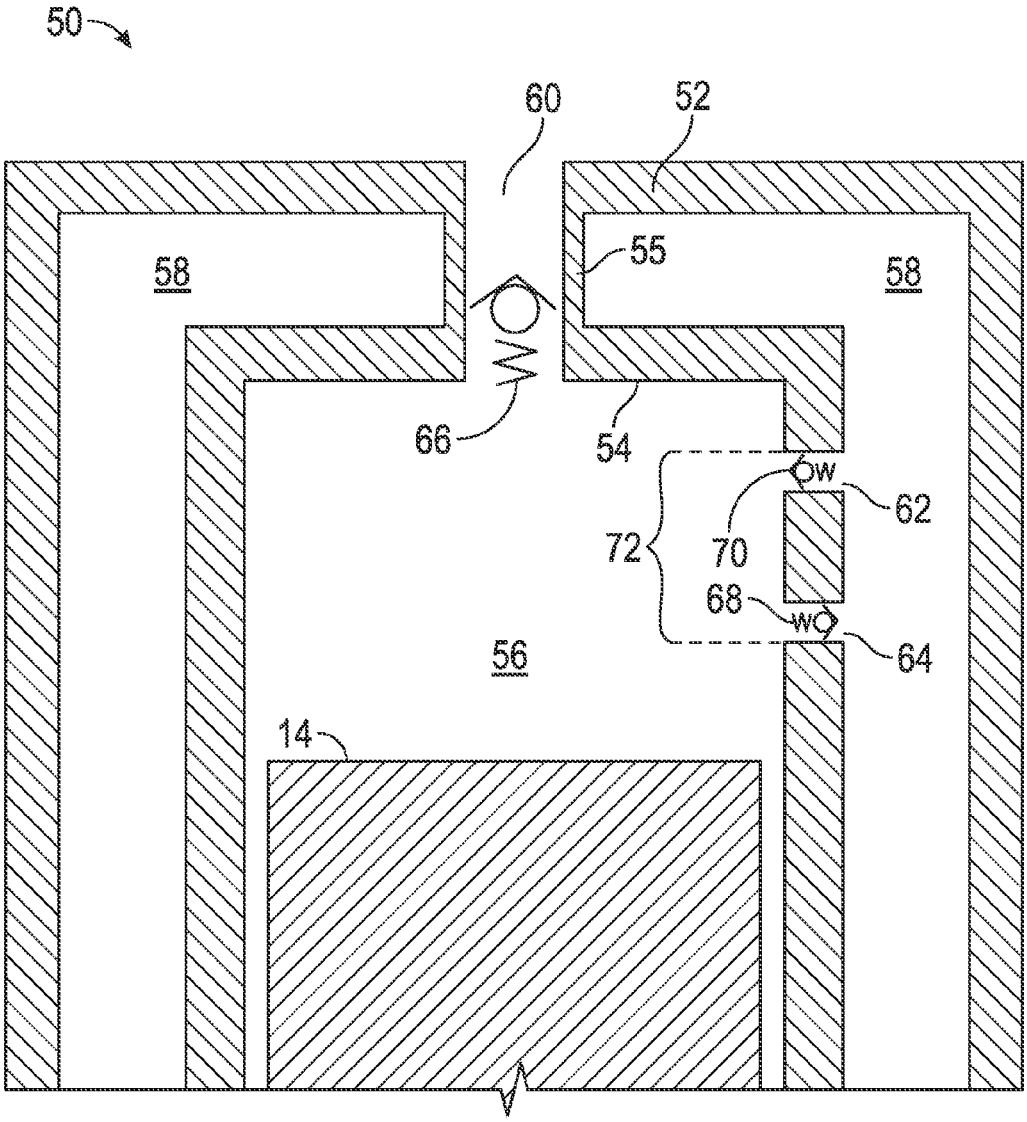
FIGS. 3-11 are enlarged views of a portion of the schematic side sectional view of FIG. 1 at different stages of a self-charging process of the hammer assembly according to the embodiment of the present disclosure.

FIG. 3 illustrates the self-charging assembly 50 before the self-charging process of the hammer assembly 10 has begun. The piston 14 is at a lowered position at the bottom of its operational cycle. Both the first gas chamber 58 and the second gas chamber 56 contain a compressible gas (such as air) at an air pressure equal to the air pressure surrounding the self-charging assembly 50 of the hammer assembly 10.

The first valve assembly 66 is oriented such that valve is held closed unless the pressure within the second gas chamber 56 is less than the air pressure surrounding the self-charging assembly 50 of the hammer assembly 10 ($P_{atm}$). Further the inflow valve 70 is oriented such that the valve is held closed unless the air pressure within the first gas chamber 58 is less than the air pressure within the second gas chamber 56. Further, the outflow valve 68 is oriented to open when the pressure within the first gas chamber 58 is less than a threshold operating pressure.

As illustrated, the first valve assembly 66, and the valves (outflow valve 68 and inflow valve 70) of the valve assembly 72 are all in closed positions due to the pressures in the first and second gas chambers 58, 56 being equal to the air pressure surrounding the self-charging assembly 50 of the hammer assembly 10. Thus, there is no communication between the first gas chamber 58 and the second gas chamber 56 in FIG. 3. Further, there is also no communication between the second gas chamber 56 and the exterior of the self-charging assembly 50 of the hammer assembly 10 in FIG. 3.

Figure 4:
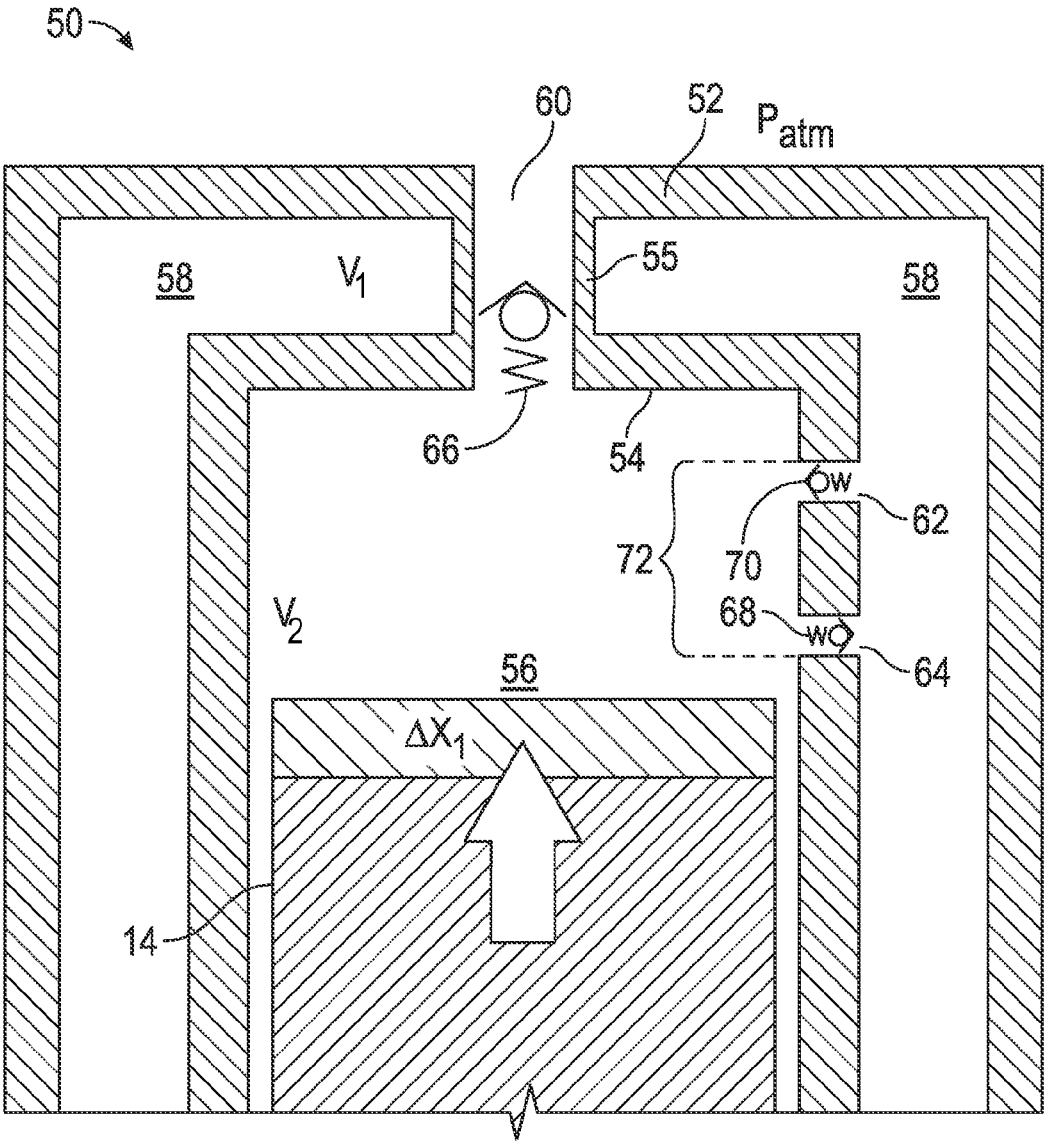

FIG. 4 illustrates the self-charging assembly 50 during a first stage of the self-charging process of the hammer assembly 10. The piston 14 is moving upward from the lowered position at the bottom of operational cycle illustrated in FIG. 3 by a first amount ($\Delta X_1$) reducing the internal volume $V_2$ and increasing the pressure within the second gas chamber 56 to be greater than the air pressure surrounding the self-charging assembly 50 of the hammer assembly 10. However, in FIG. 4, the air pressure within the second gas chamber 56 has not increased enough to open the inflow valve 70.

Thus, the first valve assembly 66 and the valves (outflow valve 68 and inflow valve 70) of the valve assembly 72 are all illustrated in closed position. As all valves are closed, there is no communication between the first gas chamber 58 and the second gas chamber 56 in FIG. 4, nor is there any communication between the second gas chamber 56 and the exterior of the self-charging assembly 50 of the hammer assembly 10.

As illustrated in FIG. 4, the internal volume $V_1$ of the first gas chamber 58 is illustrated as unchanged from FIG. 3.

Figure 5:
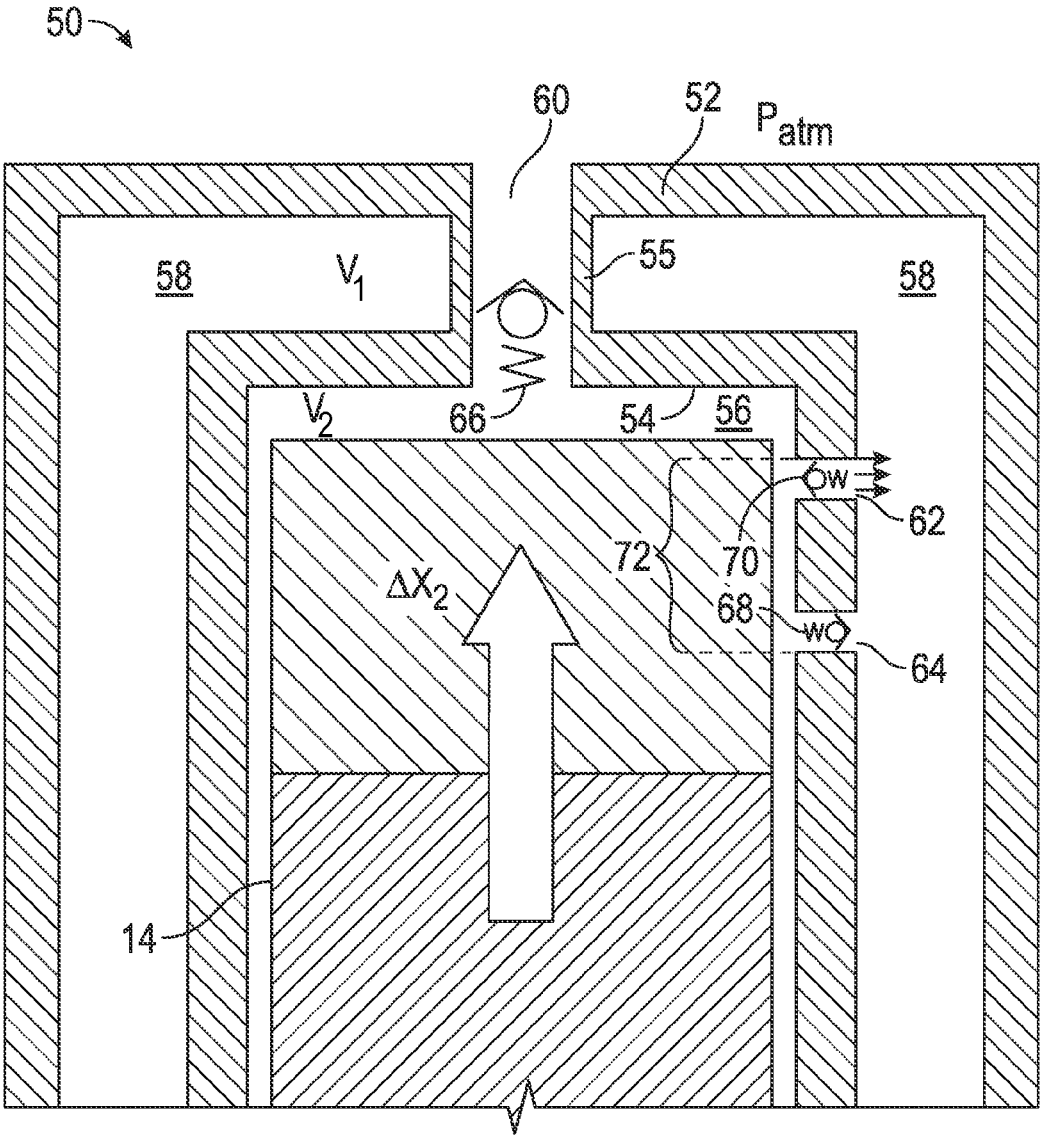

FIG. 5 illustrates the self-charging assembly 50 during a second stage of the self-charging process of the hammer assembly 10. The piston 14 has further moved upward from the lowered position at the bottom of operational cycle illustrated in FIG. 3 by a second amount ($\Delta X_2$) further reducing the internal volume $V_2$ and further increasing the pressure within the second gas chamber 56 above the air pressure surrounding the self-charging assembly 50 of the hammer assembly 10 and the first valve assembly 66 remains closed preventing communication between the second gas chamber 56 and the exterior of the self-charging assembly 50 of the hammer assembly 10.

The increased air pressure within the second gas chamber 56 ($P_2$) has caused the inflow valve 70 to open. Thus, the inflow valve 70 of the valve assembly 72 is illustrated in an opened position and communication between the second gas chamber 56 and the first gas chamber 58 is illustrated, equalizing the pressure between the second gas chamber 56 and the first gas chamber 58 at a pressure greater than the atmospheric pressure surrounding the hammer assembly 10.

As illustrated in FIG. 5, the internal volume $V_1$ of the first gas chamber 58 is illustrated as unchanged from FIG. 3.

Figure 6:
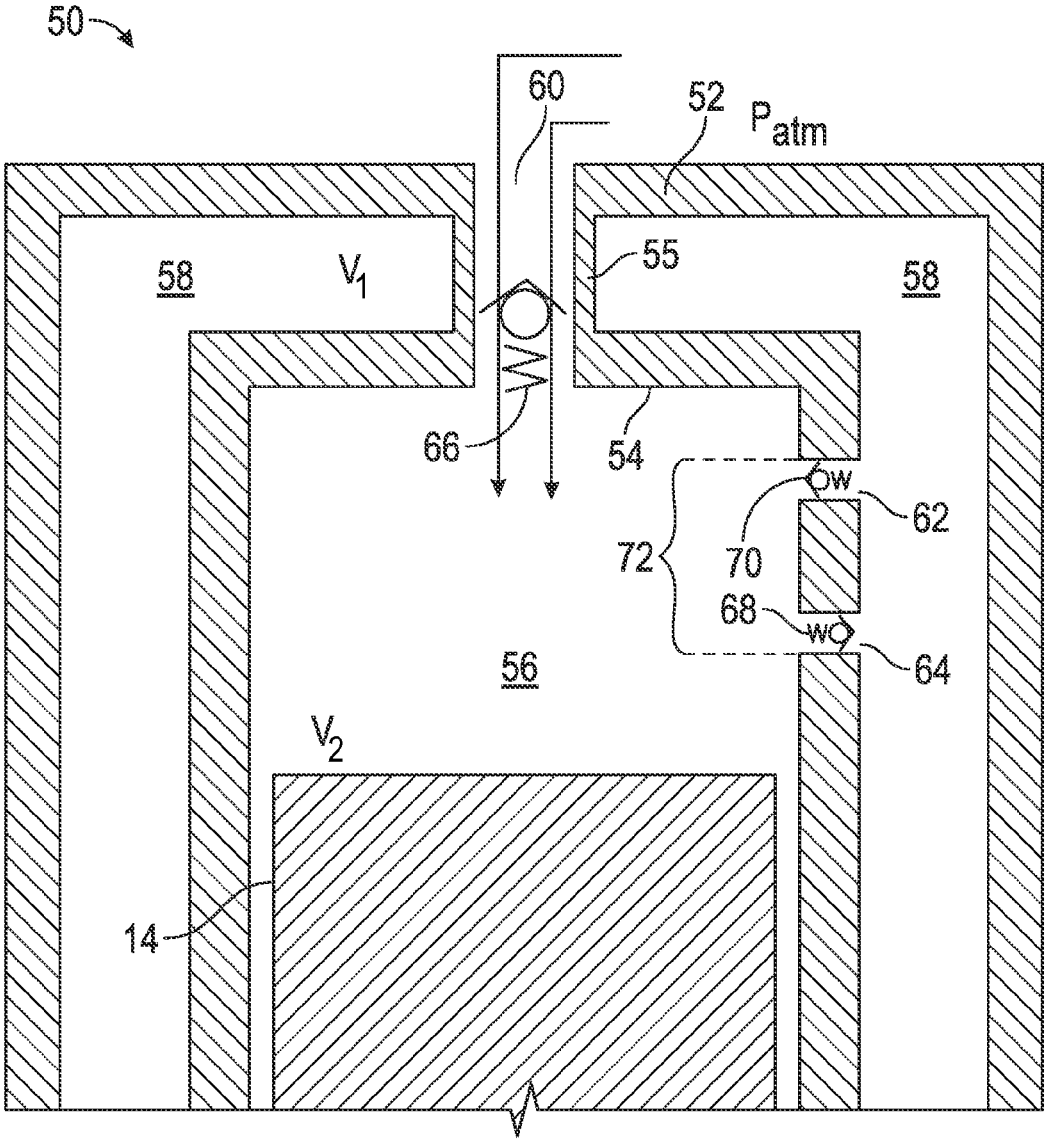

FIG. 6 illustrates the self-charging assembly 50 during a third stage of the self-charging process of the hammer assembly 10. The piston 14 has further moved downward returning to the lowered position at the bottom of operational cycle originally illustrated in FIG. 3, increasing the internal volume $V_2$ and decreasing the pressure within the second gas chamber 56 to below the pressure within the first chamber 58. The inflow valve 70 of the second valve assembly 72 has closed due to the decreased air pressure within the second gas chamber 56.

In FIG. 6, the internal volume $V_1$ of the first gas chamber 58 is illustrated as unchanged from FIG. 3. With the inflow valve 70 closed, the air pressure within the first gas chamber 58 is maintained at the pressure reached in the second stage illustrated in FIG. 5.

As illustrated, the pressure within the second gas chamber 56 has dropped below the atmospheric pressure ($P_{atm}$) surrounding the self-charging assembly 50 of the hammer assembly 10 and the first valve assembly 66 has opened allowing communication between the second gas chamber 56 and the exterior of the self-charging assembly 50 of the hammer assembly 10. With the first valve assembly 66 open, air pressure within the second gas chamber will equalize with the atmospheric pressure ($P_{atm}$) surrounding the self-charging assembly 50 of the hammer assembly 10.

Figure 7:
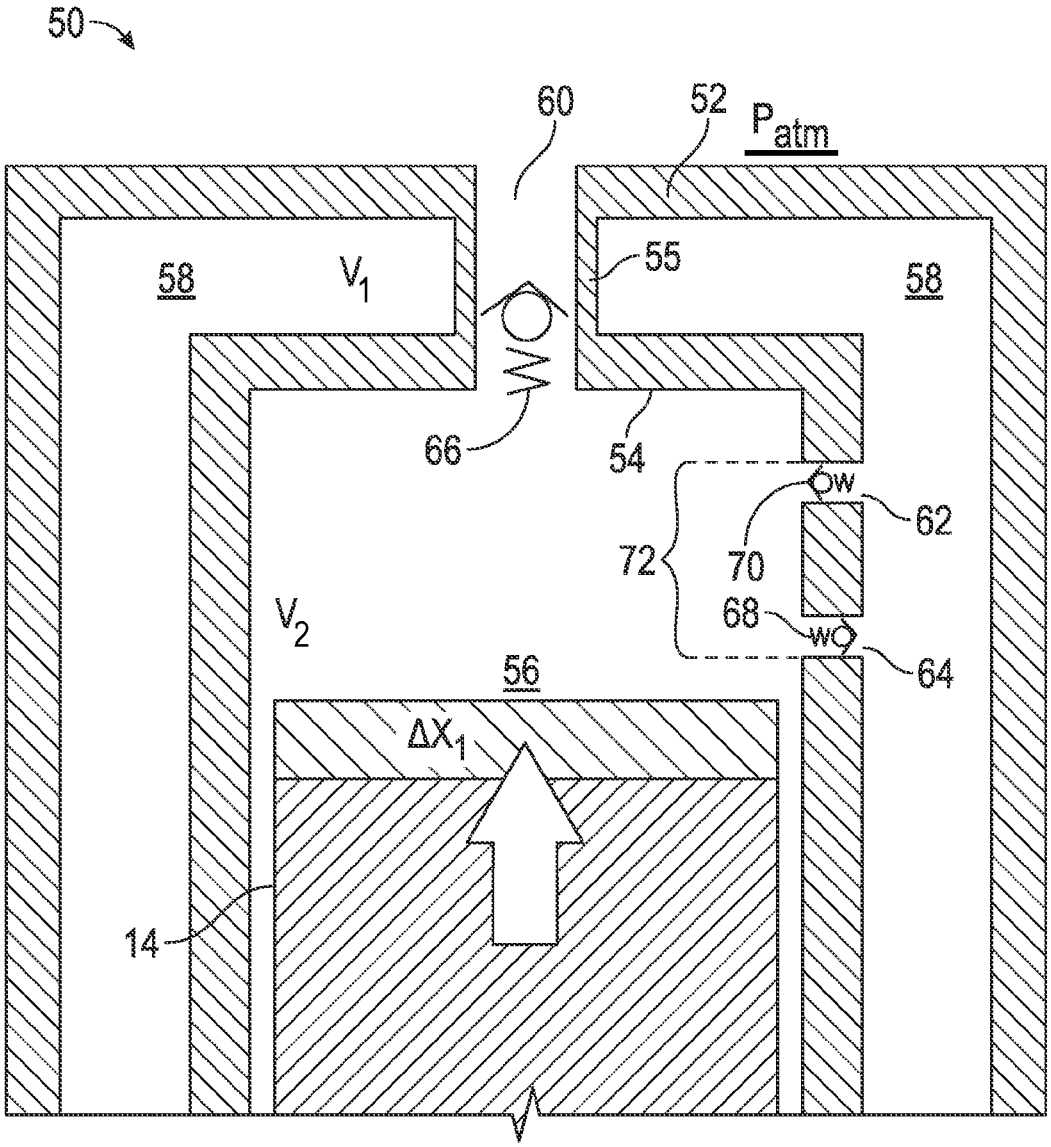

FIG. 7 illustrates the self-charging assembly 50 during a fourth stage of the self-charging process of the hammer assembly 10. The piston 14 is again moving upward from the lowered position at the bottom of operational cycle illustrated in FIG. 3 by the first amount ($\Delta X_1$) again reducing the internal volume $V_2$ and increasing the pressure within the second gas chamber 56 to be greater than the atmospheric pressure ($P_{atm}$) surrounding the self-charging assembly 50 of the hammer assembly 10. However, in FIG. 7, the air pressure within the second gas chamber 56 has not increased enough to open the inflow valve 70.

Thus, the first valve assembly 66 and the valves (outflow valve 68 and inflow valve 70) of the valve assembly 72 are all illustrated in closed positions. As all valves are closed, there is no communication between the first gas chamber 58 and the second gas chamber 56 in FIG. 4, nor is there any communication between the second gas chamber 56 and the exterior of the self-charging assembly 50 of the hammer assembly 10.

Further in FIG. 7, the internal volume $V_1$ of the first gas chamber 58 is again illustrated as unchanged from FIG. 3 and with the inflow valve 70 closed, the air pressure within the first gas chamber 58 is maintained at the pressure reached in the second stage illustrated in FIG. 5.

Figure 8:
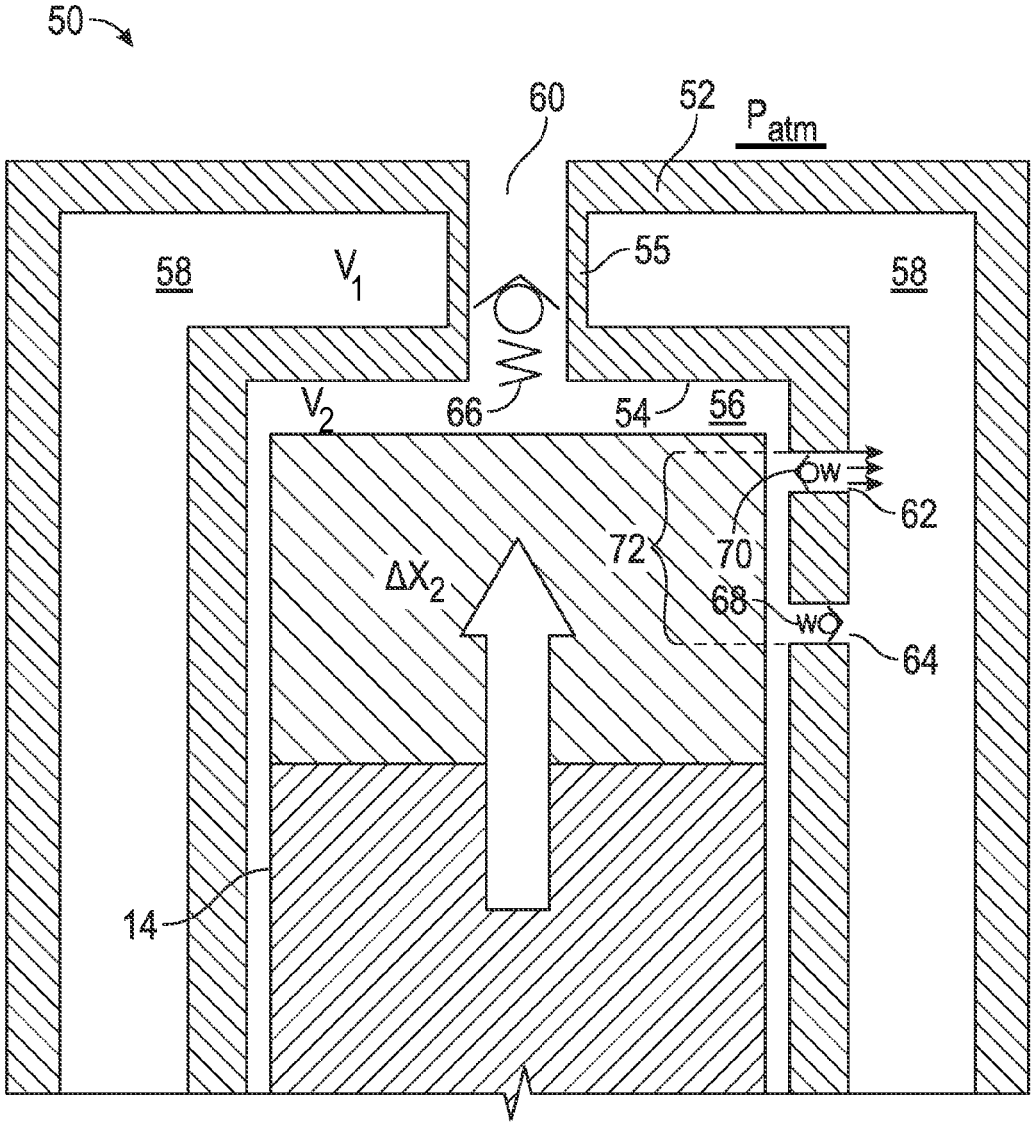

FIG. 8 illustrates the self-charging assembly 50 during a fifth stage of the self-charging process of the hammer assembly 10. The piston 14 has again further moved upward from the lowered position at the bottom of operational cycle illustrated in FIG. 3 by the second amount ($\Delta X_2$) again further reducing the internal volume $V_2$ and further increasing the pressure within the second gas chamber 56 above the atmospheric pressure ($P_{atm}$) surrounding the self-charging assembly 50 of the hammer assembly 10 and the first valve assembly 66 remains closed preventing communication between the second gas chamber 56 and the exterior of the self-charging assembly 50 of the hammer assembly 10.

In FIG. 8, the increased air pressure within the second gas chamber 56 ($P_2$) has exceeded the increased pressure within the first gas chamber 58 reached in the second stage and the inflow valve 70 has again opened. Thus, the inflow valve 70 of the valve assembly 72 is illustrated in an opened position and communication between the second gas chamber 56 and the first gas chamber 58 is illustrated, equalizing the pressure between the second gas chamber 56 and the first gas chamber 58 at a pressure greater than the increased pressure within the first gas chamber 58 reached in the second stage.

Figure 9:
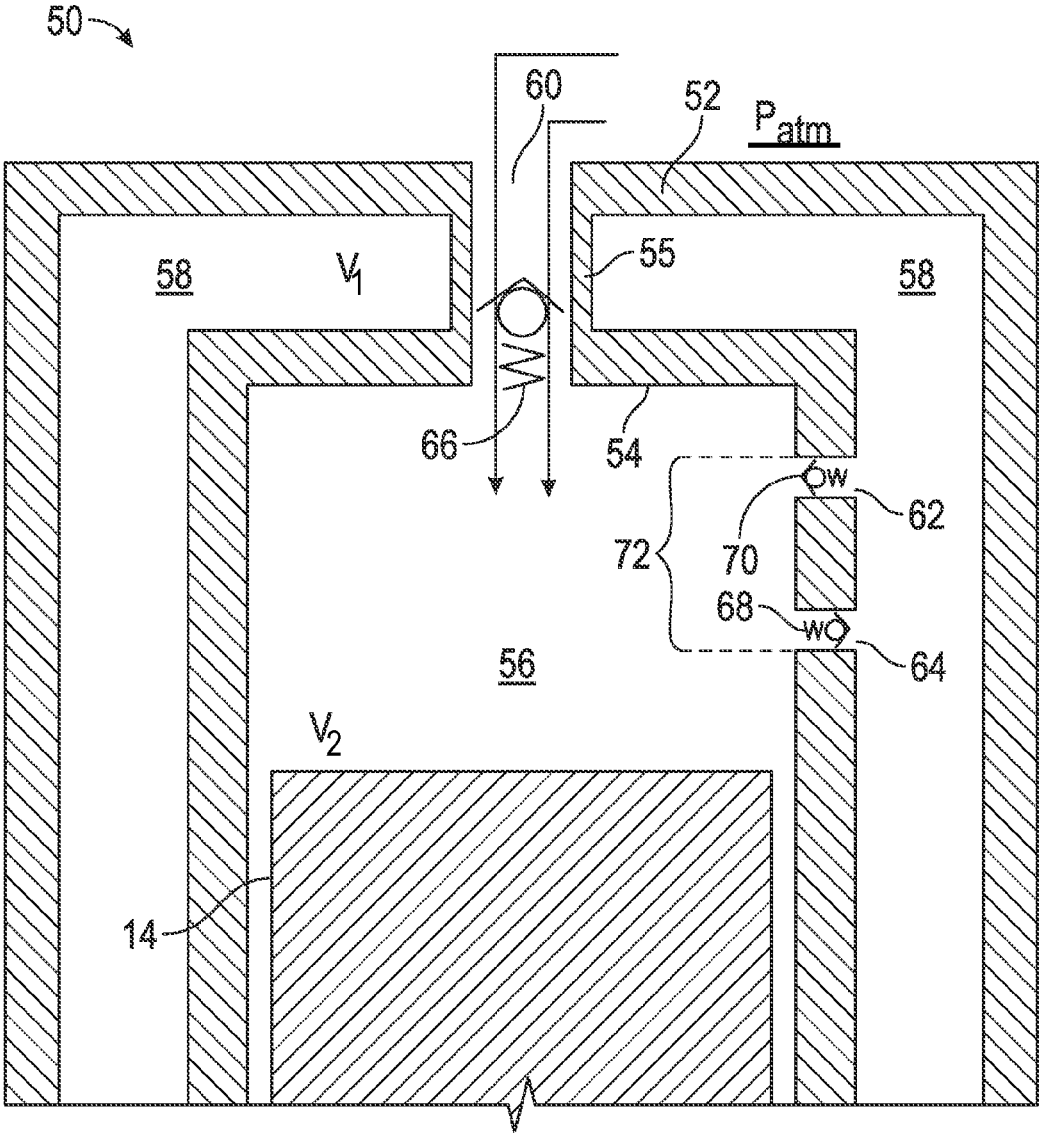

FIG. 9 illustrates the self-charging assembly 50 during a sixth stage of the self-charging process of the hammer assembly 10. The piston 14 has further again moved downward returning to the lowered position at the bottom of operational cycle originally illustrated in FIG. 3, increasing the internal volume $V_2$ and decreasing the pressure within the second gas chamber 56 to below the pressure within the first chamber 58. The inflow valve 70 of the second valve assembly 72 has again closed due to the decreased air pressure within the second gas chamber 56.

In FIG. 9, the internal volume $V_1$ of the first gas chamber 58 is again illustrated as unchanged from FIG. 3. With the inflow valve 70 closed, the air pressure within the first gas chamber 58 is maintained at the pressure reached in the fifth stage illustrated in FIG. 8.

As illustrated, the pressure within the second gas chamber 56 has dropped below the atmospheric pressure ($P_{atm}$) surrounding the self-charging assembly 50 of the hammer assembly 10 and the first valve assembly 66 has opened allowing communication between the second gas chamber 56 and the exterior of the self-charging assembly 50 of the hammer assembly 10. With the first valve assembly 66 open, air pressure within the second gas chamber will equalize with the atmospheric pressure ($P_{atm}$) surrounding the self-charging assembly 50 of the hammer assembly 10.

Figure 10:
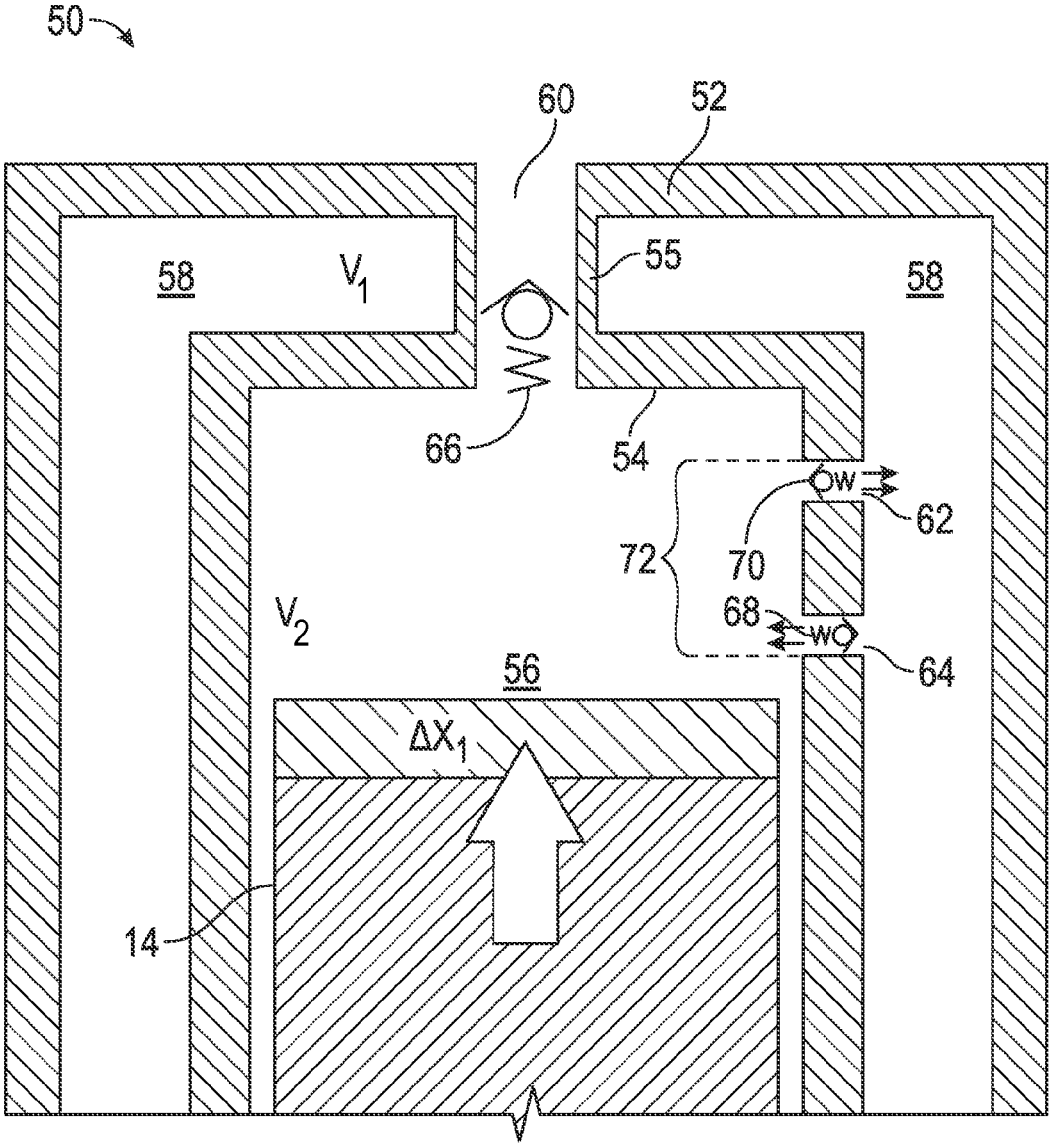

FIG. 10 illustrates the self-charging assembly 50 during a seven stage of the self-charging process of the hammer assembly 10. The piston 14 is again moving upward from the lowered position at the bottom of operational cycle illustrated in FIG. 3 by the first amount ($\Delta X_1$) again reducing the internal volume $V_2$ and increasing the pressure within the second gas chamber 56 to be greater than the atmospheric pressure ($P_{atm}$) surrounding the self-charging assembly 50 of the hammer assembly 10. Thus, the first valve assembly 66 is illustrated in a closed position.

Further, in the seventh stage illustrated in FIG. 10, the increased pressure in the second gas chamber 56 has caused the inflow valve 70 of the valve assembly 72 to open allowing air flow from the second gas chamber 56 to the first gas chamber 58. Further, the air pressure within the first gas chamber 58 has increased above a threshold pressure of the outflow valve 68 allowing airflow from the first gas chamber 58 to the second gas chamber 56. Thus, both valves (inflow valve 70 and outflow valve 68) of the second valve assembly 72 are illustrated in an open position.

Figure 11:
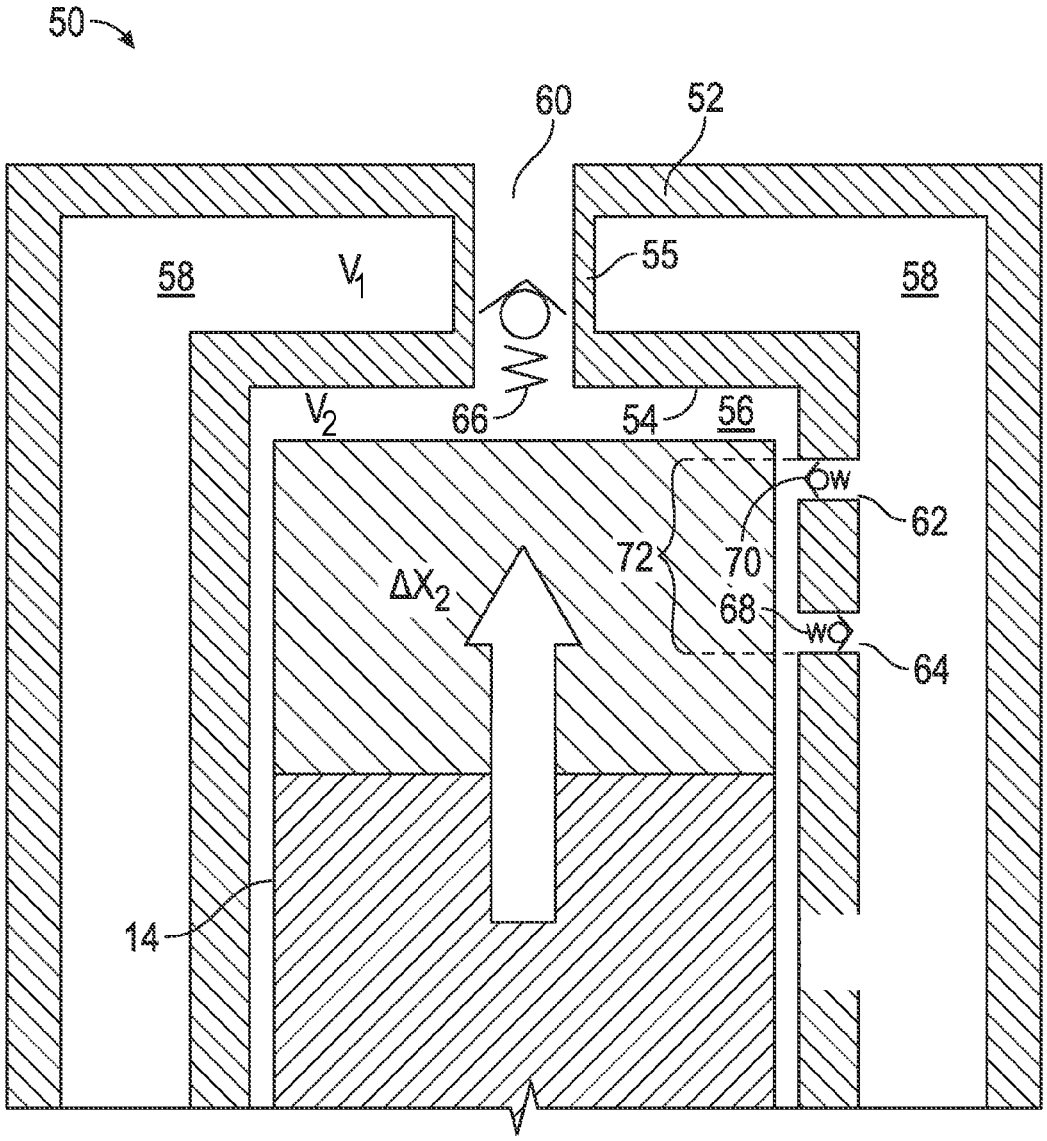

FIG. 11 illustrates the self-charging assembly 50 at the completion of self-charging process of the hammer assembly 11. The piston 14 has further moved upward from the lowered position at the bottom of operational cycle illustrated in FIG. 3 by a second amount ($\Delta X_2$) further reducing the internal volume $V_2$ and further increasing the pressure within the second gas chamber 56 above the threshold pressure of outflow valve 68. The first valve assembly 66 is illustrated in a closed position preventing communication between the second gas chamber 56 and the exterior of the self-charging assembly 50 of the hammer assembly 10. Further, the second valve assembly 72 is also illustrated as closed preventing communication between the first gas chamber 58 and the second gas chamber 56.

Figure 13:
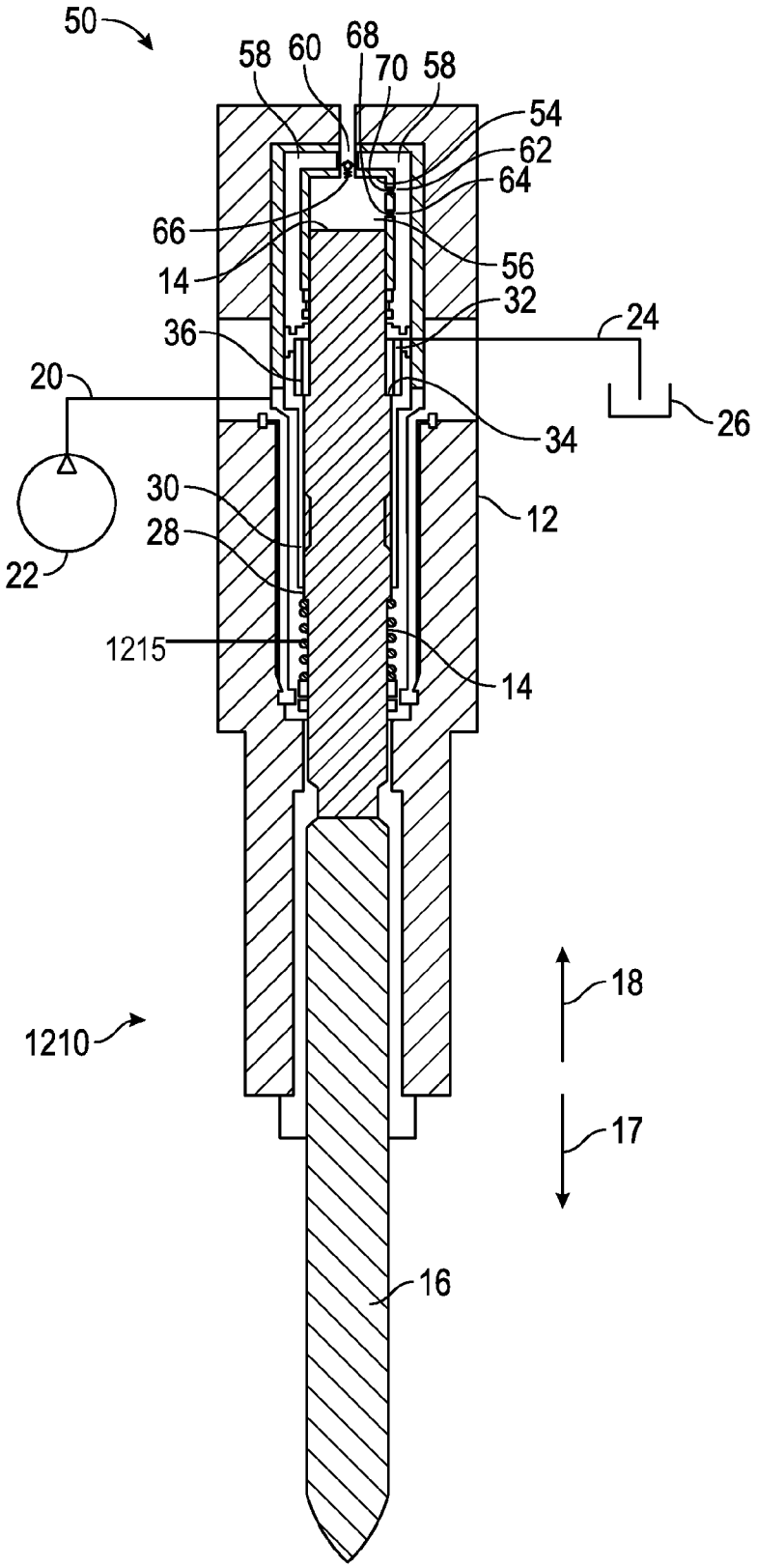
FIG. 13 is a schematic side sectional view of a hammer assembly according to another embodiment of the present disclosure.

FIG. 13 illustrates a schematic side sectional view of another hammer assembly 1210 according to another embodiment of the present disclosure. The structure of the hammer assembly 1210 is similar to the structure of the hammer assembly 10 illustrated in FIG. 2 and discussed above. Thus, like reference numerals have been used for structurally similar components and redundant description of these similar components has been omitted. The hammer assembly 1210 includes a biasing member 1215 that biases the piston 14 downward toward the work tool 16. The biasing member 1215 is not particularly limited and may include a spring or any other element which may bias the piston 14 toward the work tool 16 as may be apparent to a person of ordinary skill in the art.

With the biasing member 1215 biasing the piston 14 toward the work tool 16, the piston 14 may be moved or reciprocated by application of external force to the work tool 16 to drive the self-charging assembly 50 without use of the hydraulic pump 22. For example, an operator of the machine 80 may move the hammer assembly 1210 against an object or ground 84 using the implement system 82 to push the work tool 16 in-and-out, driving the piston 14 and operating the self-charging apparatus.

INDUSTRIAL APPLICABILITY

The present disclosure generally applies to a hammer assembly having a self-charging assembly 50. The self-charging assembly 50 described herein may be implemented in hydraulic hammers of any size or configuration that include gas chambers for providing at least some of the impact energy for the hammer. As referenced above, an embodiment of a hammer assembly 10 illustrated in FIG. 2, reciprocating movement of the piston 14 may be driven, at least in part, by pressurized fluid, such as pressurized hydraulic fluid, provided by a high pressure source connected to the power source 90 of the machine 80 via the implement system 8. Specifically, the piston 14 may be moved in the upward direction away from the work tool 16 (i.e., in the direction of arrow 18; in some embodiments the upward direction away from the work tool 16 may be identified as a direction opposite the working direction described below), by providing pressurized fluid from the pump 22 into the first fluid chamber 30 via the inlet 20 with the control valve assembly 36 in a closed position. As the pressurized fluid is provided into the first fluid chamber 30, the pressurized fluid may contact the upward fluid engagement surface 28 to move the piston 14 in the direction of arrow 18 away from the work tool 16. To moving the piston 14 in the downward direction towards the work tool 16 (i.e., in the direction of arrow 17; in some embodiments the downward direction toward the work tool 16 may be identified as a working direction), the pressurized fluid is provided from the pump 22 into the second fluid chamber 34 via the inlet 20 with the control valve assembly 36 in a closed position. As the pressurized fluid is provided to the second fluid chamber 34, the pressurized fluid may contact a downward fluid engagement surface 32 of the piston 14. As the downward fluid engagement surface 32 may be configured with a larger effective surface area than the upward fluid engagement surface 28 such that the piston 14 is driven downward in the general direction of arrow 17 when both the first and second fluid chambers 30, 34 are in communication with the high pressure inlet 20. Conversely, when only the first fluid chamber 30 is in communication with the high pressure inlet 20, high pressure fluid only acts on the upward fluid engagement surface 28 and the piston 14 is driven upward. Those skilled in the art will appreciate that the present disclosure is not limited to the specific pressurized fluid system and other suitable arrangements capable of driving upward and downward reciprocating movement of the piston 14 may be used.

To generate a further downward force on the piston 14 for the work stroke, the second gas chamber 56 (henceforth referred to as the second gas chamber 56) is charged with a trapped pressurized gas that is compressible using the self-charging assembly 50 and a self-charging process such as the process described below. When the piston 14 retracts into the second gas chamber 56 during a return stroke, the piston 14 reduces the effective volume of the second gas chamber 56. As the effective volume is decreased, the pressure of gas corresponding increases and produces a downward biasing force acting on the upper end surface of the piston 14 is produced. When the second fluid chamber 34 is connected to the pump 22 initiating the downward work stroke of the piston 14, the biasing force from the compressed gas in the second gas chamber 56 combines with the downward force from the high pressure fluid acting on the downward fluid engagement surface 32 to drive the piston 14 downward and into engagement with the work tool 16.

Figure 12:
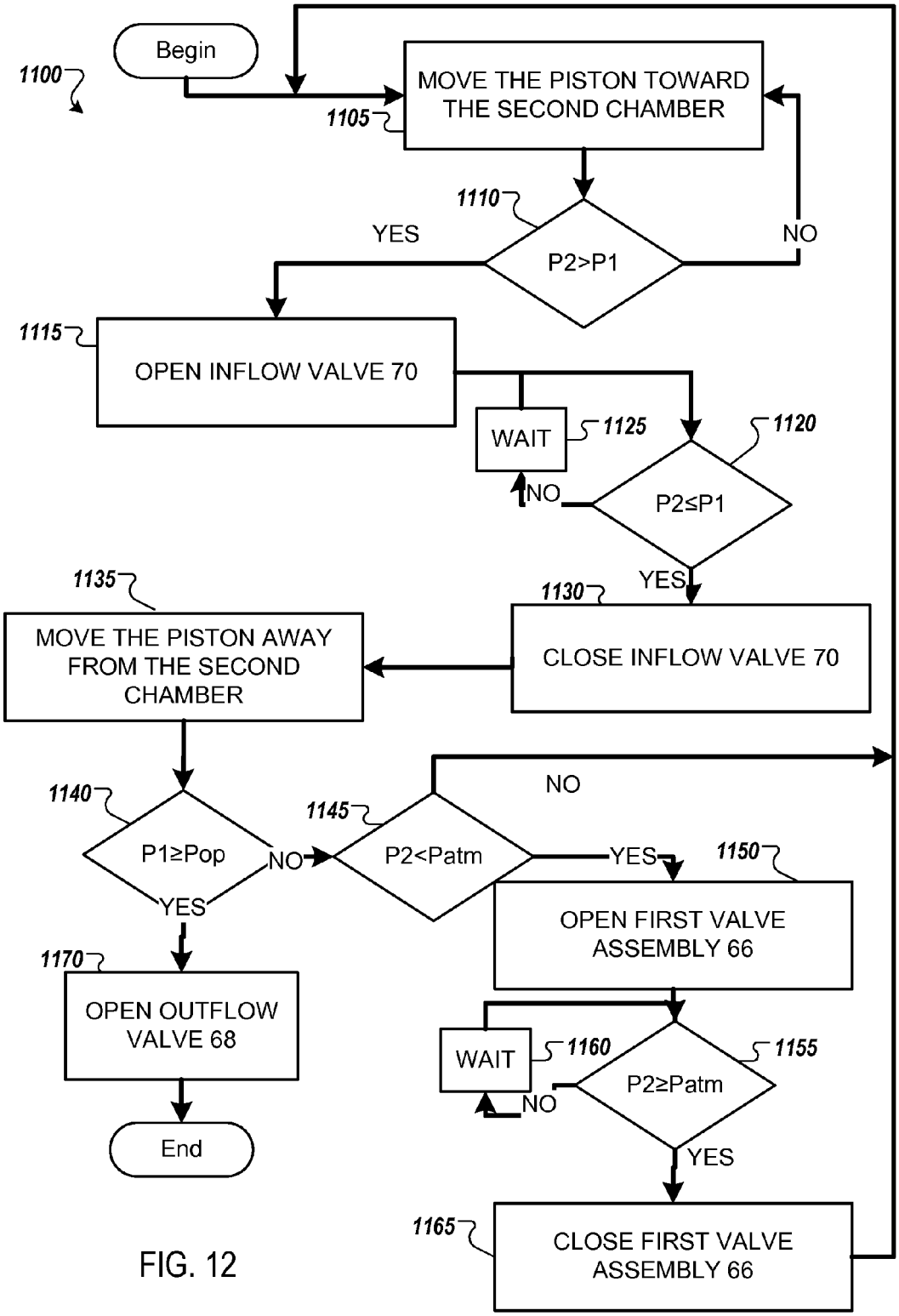
FIG. 12 is a flowchart of a process for self-charging the hammer assembly according to the embodiment of the present disclosure.

FIG. 12 is a flowchart of a process 1100 for self-charging the hammer assembly 10. During the discussion of the process 1100 reference is made to FIGS. 2-10 previously discussed above to illustrate an example configuration of the self-charging assembly 50 during the self-charging process 1100. Further, for the purposes of discussion, the pressure within the first chamber 58 is referred to below as Pressure 1 ($P_1$) and the pressure within the second chamber 56 is referred to below as Pressure 2 ($P_2$). In the following discussion, the piston 14 may be moved up and down within the second fluid chamber 34. In some embodiments, movement of the piston 14 may be achieved through by applying pressurized fluid, such as pressurized hydraulic fluid, provided by a high pressure source connected to the power source 90 of the machine 80 via the implement system 8 as discussed above with respect to FIG. 2. In other embodiments using a hammer assembly 1210 illustrated in FIG. 13, the movement of the piston 14 may be achieved through application of an external force to the work tool 16 and transmitted to the piston 14, which is in contact with the work tool 16 due to a biasing force provided by a biasing member 1215. For example, an operator of the machine 80 may move the hammer assembly 1210 against an object or ground 84 to push the work tool 16 in-and-out and this in-and-out movement of the work tool 16 may be transmitted to the piston 14 causing the piston 14 to move up and down as would be apparent to a person of ordinary skill in the art. As an initial matter, FIG. 3 illustrates a configuration of the self-charging assembly 50 before the self-charging process 1110 has begun. The piston 14 is in the lowered position at the bottom of the operational cycle. Initially, the air pressure within both the first gas chamber ($P_1$) and the second gas chamber ($P_2$) are equal to the atmospheric pressure ($P_{atm}$) surrounding the self-charging assembly 50 of the hammer assembly 10. As there is no pressure differential between the first gas chamber 58 and the second gas chamber 56, the inflow valve 70 and the outflow valve 68 of the second valve assembly 72 are closed. Further, as there is no pressure differential between the second gas chamber 56 and the atmospheric pressure ($P_{atm}$) surrounding the self-charging assembly 50 of the hammer assembly 10, the first valve assembly 66 is also closed.

As the process 1100, the piston 14 begins to move upward toward or into the second has chamber 56 in 1105. FIG. 4 illustrates the piston 14 beginning to move upward in 1105. As the piston 14 is moved upward, the volume $V_2$ is gradually decreased causing the pressure $P_2$ to gradually increase.

At 1110, a determination is made whether the pressure $P_2$ in the second gas chamber 56 exceeds the pressure $P_1$ in the first gas chamber 58. If it is determined that the pressure $P_2$ in the second gas chamber 56 does not exceed the pressure $P_1$ in the first gas chamber 58 (NO), the process 1100 returns to 1105 and the piston 14 continues to move upward toward or into the second gas chamber 56.

Conversely, if it determined at 1110 that the pressure $P_2$ in the second gas chamber 56 does exceed the pressure $P_1$ in the first gas chamber 58 (YES), the inflow valve 70 is opened in 1115. FIG. 5 illustrates that the piston 14 has moved further upward enough to decrease the volume $V_2$ enough to cause the pressure $P_2$ to increase to greater than the pressure $P_1$ in the first gas chamber 58. The pressure difference between the second gas chamber 56 and the first gas chamber 58 has caused the inflow valve 70 has opened. In some embodiments, the inflow valve 70 may be configured be opened by any pressure differential (i.e. open when $P_2$ exceeds $P_1$ by any amount). For example, the valve may open if $P_1$=14.7 pounds/in$^2$ (PSI; 101,325 Pascal (Pa)) and $P_2$=14.8 PSI (102,014 Pa)). In other embodiments, the inflow valve 70 may be configured to only open when the pressure differential exceeds a certain threshold (i.e. open when $P_2$ exceeds $P_1$ by a threshold amount. For example, the valve may not open until $P_2$ exceeds $P_1$ by at least 5 PSI (34,464 Pa). In other embodiments, the valve may be opened by a control signal from a controller.

Once the inflow valve 70 has been opened, the upward movement of piston 14 may be stopped in some embodiments. In other embodiments, the upward movement of the piston 14 may be continued until an upper limit of the operational cycle is reached. After the inflow valve 70 has been opened, a determination is made whether the pressure $P_2$ in the second gas chamber 56 equals or is less than the pressure $P_1$ in the first gas chamber 58 at 1120. If the pressure $P_2$ is still greater than the pressure $P_1$ (NO), the process 1100 waits until the pressure $P_2$ and the pressure $P_1$ equalize at 1125.

Once it is determined in 1120 that the pressure $P_2$ in the second gas chamber 56 equals or is less than the pressure $P_1$ in the first gas chamber 58, the inflow valve 70 closes or is closed in 1130 and the piston 14 is moved downward away from or out of the second gas chamber 56 in 1135. As the piston 14 moves downward, the volume $V_2$ of the second gas chamber 56 increases and the pressure $P_2$ in the second gas chamber decreases proportionally.

As the pressure $P_2$ decreases, a determination is made whether the Pressure $P_1$ equals or exceeds an operating pressure ($P_{op}$) at which the hammer assembly 10 can operate effectively (i.e. hammer assembly 10 is charged) at 1140. In some embodiments, the operating pressure $P_{op}$ may be in a range of 100 PSI (689,285 Pa/689 kPa) to 175 PSI (1,206, 250 Pa/1,206 kPa). In other embodiments, operating pressure may be in a range of 200 PSI (1,378,572 Pa/1,379 kPa) to 400 PSI (2,757,142 Pa/2,757 kPa). In some embodiments, the operating pressure may be equal to or greater than 230 PSI (1,585,356 Pa/1,585 kPa).

If the pressure $P_1$ does not equal or exceed the operating pressure $P_{op}$ (NO), a determination is made whether the pressure $P_2$ in the second gas chamber 56 is less than the atmospheric pressure $P_{atm}$ surrounding the self-charging assembly 50 of the hammer assembly 10 at 1145. If it is determined that the pressure the pressure $P_2$ in the second gas chamber 56 is less than the atmospheric pressure $P_{atm}$ surrounding the self-charging assembly 50 of the hammer assembly 10 (YES), the first valve assembly 66 is opened in 1150.

FIG. 6 illustrates that the piston 14 has moved to the bottom of its operation cycle and the volume $V_2$ has increased enough to cause the pressure $P_2$ to decrease to less than the atmospheric pressure $P_{atm}$ surrounding the self-charging assembly 50 of the hammer assembly 10. As illustrated in FIG. 6, the internal volume $V_1$ of the first gas chamber 58 is illustrated as unchanged during the process 1100 and with the inflow valve 70 closed, the air pressure within the first gas chamber 58 is maintained at the pressure reached in 1120.

In some embodiments, the first valve assembly 66 may be configured be opened by any pressure differential (i.e. open when $P_{atm}$ exceed $P_2$ by any amount). For example, the first valve assembly 66 may open if $P_{atm}$=14.7 PSI (101,325 Pascal (Pa)) and $P_2$=14.6 PSI (102,014 Pa)). In other embodiments, the first valve assembly 66 may be configured to only open when the pressure differential exceeds a certain threshold (i.e. open when $P_{atm}$ exceeds $P_2$ by a threshold amount). For example, the valve may not open until $P_{atm}$ exceeds $P_2$ by at least 5 PSI (34,464 Pa).

After the first valve assembly 66 has been opened, a determination is made whether the pressure $P_2$ in the second gas chamber 56 equals or exceeds the pressure $P_{atm}$ surrounding the self-charging assembly 50 of the hammer assembly 10 at 1155. If the pressure $P_2$ is still less than the pressure $P_{atm}$ (NO), the process 1100 waits until the pressure $P_2$ and the pressure $P_1$ equalize at 1160.

Once it is determined in 1155 that the pressure $P_2$ in the second gas chamber 56 equals or exceed the pressure $P_1$ the pressure $P_{atm}$ surrounding the self-charging assembly 50 of the hammer assembly 10 at 1155, the first valve assembly 66 closes or is closed at 1165 and the process returns to 1105 where the piston 14 again is moved upward toward or into the second gas chamber 56. The process 1100 also returns to 1105 if it is determined in 1145 that the P2 is not less than the atmospheric pressure $P_{atm}$ surrounding the self-charging assembly 50 of the hammer assembly 10 (NO at 1145). Steps 1105-1140 are repeated until the pressure $P_1$ in the first gas chamber 58 equals or exceed the operating pressure $P_{op}$ (YES at 1140).

FIG. 7 illustrates a second or subsequent cycle of the piston 14 being moved toward or into the second gas chamber 56 while the determination of 1110 is being performed. FIG. 8 illustrates a second or subsequent cycle of the piston 14 having been moved to an upper limit of its operation cycle, and the inflow valve 70 opening while the pressure equalizes during the determination of 1120. FIG. 9 illustrates a second and subsequent cycle of the piston 14 being positioned at the lowered position at the bottom of its operational cycle and the first valve assembly 66 has been opened in 1150 while the determination of 1155 is made. As the first gas chamber 58 has a fixed volume and does not have any fluid connection allowing air flow out when outflow valve 68 is closed, the pressure $P_1$ increases in each successive cycle.

Returning to 1140, when the pressure $P_1$ in the first gas chamber 58 equals or exceeds the operating pressure $P_{op}$, the outflow valve 68 opens or is opened and air flow out of the first gas chamber 58 is allowed in 1170. FIG. 10 illustrates the self-charging assembly with the outflow valve 68 in an opened position. With the outflow valve 68 open, the piston 14 can be moved upward or downward, causing the inflow valve 70 to open and close based on the pressure differential between the first gas chamber 58 and the second gas chamber 56. FIG. 11 illustrates the self-charging assembly 50 at the completion of self-charging process 1100 of the hammer assembly 10.

Once the pressure $P_1$ in the first gas chamber 58 equals or exceeds the operating pressure $P_{op}$ and the outflow valve 68 opens or is opened, the self-charging process 1100 of the self-charging assembly 50 is considered completed and normal operation of the hammer assembly 10 may be performed. FIG. 11 illustrates the self-charging assembly 50 at the completion of self-charging process 1100 of the hammer assembly 10 with the inflow valve 70 and outflow valve 68 in closed positions. During operation, air may flow back and forth between first gas chamber 58 and the second gas chamber 56 as the inflow valve 70 and outflow valve 68 open and close based on changes in the pressure differentials.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Further, embodiments of the present application are described herein with reference to a hydraulic or hydro-mechanical hammer assemblies, but embodiments of the present application are not limited to hydraulic or hydro-mechanical hammer assemblies, and may include other hydro-mechanical devices having a self-charging assembly as described herein.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A self-charging assembly for a hammer assembly, the self-charging assembly comprising:

a first side wall, a second side wall disposed within the first side wall, and a third side wall connecting the first side wall and the second side wall;

a first gas chamber defined by the first side wall, the second side wall and the third side wall, the first gas chamber configured to hold a compressible gas;

a second gas chamber disposed within the first gas chamber and defined by the second side wall, the second gas chamber configured to hold a compressible gas;

a first valve assembly configured for selectively placing an interior portion of the second gas chamber in communication with an atmosphere outside of the self-charging assembly; and a second valve assembly having, an inflow valve configured to place the interior portion of the first gas chamber in communication with interior portion of the second gas chamber when an air pressure within the first gas chamber is below an air pressure of the second gas chamber, and block communication between the interior portion of the second gas chamber and the interior portion of the first gas chamber when the air pressure within the first gas chamber is greater than the air pressure in the second gas chamber, and an outflow valve configured to place the interior portion of the first gas chamber in communication with interior portion of the second gas chamber when an air pressure within the first gas chamber is greater than or equal to a threshold pressure, and block communication between the interior portion of the second gas chamber and the interior portion of the first gas chamber when the air pressure within the first gas chamber is less than the threshold pressure.

2. The self-charging assembly according to claim 1, wherein the first valve assembly is configured to place the interior portion of the second gas chamber in communication with the atmosphere outside the self-charging assembly when an air pressure within the second gas chamber is below an air pressure of the atmosphere outside of the self-charging assembly; and wherein the first valve assembly is configured to block communication between the interior portion of the second gas chamber and the atmosphere outside of the self-charging assembly when the air pressure within the second gas chamber is equal or greater than the air pressure in the atmosphere outside of the self-charging assembly.

3. The self-charging assembly according to claim 2, wherein the first valve assembly is a check valve having a biasing member, which holds the check valve closed when the air pressure within the second gas chamber is equal or greater than the air pressure in the atmosphere outside of the self-charging assembly.

4. The self-charging assembly according to claim 1, wherein the inflow valve is a check valve having a biasing member, which holds the check valve closed when the air pressure within the first chamber is greater than the air pressure in the second gas chamber.

5. The self-charging assembly according to claim 1, wherein the threshold pressure is greater than or equal to 100 PSI and less than or equal to 230 PSI.

6. A hammer assembly comprising:

the self-charging assembly according to claim 1;

a work tool supported below the self-charging assembly; and a piston movably disposed in the self-charging assembly between the second gas chamber and the work tool, the piston configured to move in a first direction away from the work tool, thereby compressing the compressible gas in the second gas chamber producing a biasing force on the piston acting in a second direction toward the work tool.

7. A self-charging assembly for a hydro-mechanical device, the self-charging assembly including a first gas chamber configured to hold a compressible gas;

a second gas chamber disposed within the first gas chamber, the second gas chamber configured to hold a compressible gas;

a first flow passage connecting an interior portion of the second gas chamber with an atmosphere outside of the self-charging assembly, the first flow passage having a first valve assembly configured for selectively blocking flow through the first flow passage; and a second flow passage connecting an interior portion of the first gas chamber with the interior portion of the second gas chamber, the second flow passage having a second valve assembly, the second valve assembly having an inflow valve configured to allow flow through the second flow passage when an air pressure within the first gas chamber is below an air pressure of the second gas chamber, and block flow through the second flow passage when the air pressure within the first gas chamber is greater than the air pressure in the second gas chamber, and an outflow valve configured to allow flow through the second flow passage when an air pressure within the first gas chamber is greater than or equal to a threshold pressure, and block flow through the second flow passage when the air pressure within the first gas chamber is less than the threshold pressure.

8. The self-charging assembly according to claim 7, wherein the first valve assembly is configured to allow flow through the first flow passage when an air pressure within the second gas chamber is below an air pressure of the atmosphere outside of the self-charging assembly; and wherein the first valve assembly is configured to block flow through the first flow passage when the air pressure within the second gas chamber is equal or greater than the air pressure in the atmosphere outside of the self-charging assembly.

9. The self-charging assembly according to claim 8, wherein the first valve assembly is a check valve having a biasing member, which holds the check valve closed when the air pressure within the second chamber is equal or greater than the air pressure of the atmosphere outside of the self-charging assembly.

10. The self-charging assembly according to claim 7, wherein the inflow valve is a check valve having a biasing member, which holds the check valve closed when the air pressure within the first chamber is greater than the air pressure in the second gas chamber.

11. The self-charging assembly according to claim 7, wherein the threshold pressure is greater than or equal to 100 PSI and less than or equal to 230 PSI.

12. A hydro-mechanical device comprising:

the self-charging assembly according to claim 7; and a piston movably disposed in the self-charging assembly between the second gas chamber and a work tool, the piston configured to move in a first direction away from the work tool, thereby compressing the compressible gas in the second gas chamber producing a biasing force on the piston acting in a working direction opposite the first direction.

13. A method of charging a hydro-mechanical device having a self-charging assembly with a compressible gas, the self-charging assembly defining a first gas chamber and a second gas chamber, and having a piston movably disposed in the self-charging assembly adjacent the second gas chamber, the method comprising:

moving the piston toward the second gas chamber to decrease an internal volume of the second gas chamber;

opening an inflow valve to allow communication from the second gas chamber to the first gas chamber, when a pressure within the second gas chamber exceeds a pressure within the first gas chamber;

closing the inflow valve to block communication from second gas chamber to the first gas chamber when the pressure within the first gas chamber equals or is less than the pressure within the second gas chamber;

moving the piston away from the second gas chamber to increase the internal volume of the second gas chamber;

opening a first valve assembly to allow communication between the second gas chamber and an atmosphere outside the self-charging assembly;

closing the first valve assembly to block communication between the second gas chamber and the atmosphere outside the self-charging assembly, moving the piston toward the second gas chamber to decrease the internal volume of the second gas chamber; and opening an outflow valve to allow communication from the first gas chamber to the second gas chamber.

14. The method of claim 13, wherein the opening a first valve assembly comprises opening the first valve assembly when the pressure within the second gas chamber is less than a pressure in the atmosphere outside the self-charging assembly.

15. The method of claim 13, wherein the closing the first valve assembly comprises closing the first valve assembly when the pressure within the second gas chamber is equal to or greater than a pressure in the atmosphere outside the self-charging assembly.

16. The method of claim 13, wherein the opening an outflow valve to allow communication from the first gas chamber to the second gas chamber comprises opening the outflow valve when a pressure within the first gas chamber exceeds a threshold operating pressure of hydro-mechanical device.

* * * * *